US005579976A

United States Patent [19]

Kunreuther et al.

[11] Patent Number: 5,579,976

[45] Date of Patent: Dec. 3, 1996

[54] DOUBLE NEEDLE BUTTON ATTACHER

[76] Inventors: Steven Kunreuther, 285 Central Park West, New York, N.Y. 10024; Jack Kalbfeld, 4 Lesley La., Old Bethpage, N.Y. 11804

[21] Appl. No.: 416,462

[22] Filed: Apr. 4, 1995

[51] Int. Cl.[6] ..... B65C 5/06; B25C 1/00

[52] U.S. Cl. ..... 227/71

[58] Field of Search ..... 227/67, 71, 68, 227/69, 70

[56] References Cited

U.S. PATENT DOCUMENTS

| | | | |
|---|---|---|---|
| 2,605,943 | 6/1952 | Hoefle . | |
| 2,707,783 | 5/1955 | Sullivan | 227/71 |
| 3,470,834 | 10/1969 | Bone . | |
| 4,039,078 | 8/1977 | Bone . | |
| 4,111,347 | 9/1978 | Bone . | |
| 4,281,782 | 8/1981 | Marsh et al. . | |
| 4,296,698 | 10/1981 | Davidson et al. . | |
| 4,316,562 | 2/1982 | Davidson et al. . | |
| 4,361,101 | 11/1982 | Marsh et al. . | |
| 4,533,076 | 8/1985 | Bourque . | |
| 4,969,589 | 11/1990 | Kim . | |
| 5,205,458 | 4/1993 | Kunreuther . | |

*Primary Examiner*—Scott A. Smith

*Attorney, Agent, or Firm*—James & Franklin; Robert L. Epstein; Harold James

[57] ABSTRACT

Within a rigid housing cavity, freely moveably received members respectively support oppositely oriented spaced needles. Double "T" bar end type attachments situated between parallel connector bars are dispensed through the needles to attach buttons. Depressing protrusions accessible from the exterior of the housing moves the needle support members to alter the needle spacing to accomodate buttons with a variety of thread hole spacings. In order to reduce the peak force necessary to sever the attachments from the connector bars, the connector bars are severed from the ends of each attachment at slightly different times during the trigger stroke. A triangular linkage associated with the trigger provides a mechanical advantage which increases at an increasing rate, transmitting maximum force towards the end of the stroke, as the filament connecting the "T" bars stretches around the portion of the button between the thread holes. The ejector rods are moveably mounted such that alignment between each ejector rod and the associated needle is maintained regardless of changes in the relative position of the needles.

10 Claims, 8 Drawing Sheets

FIG. 6
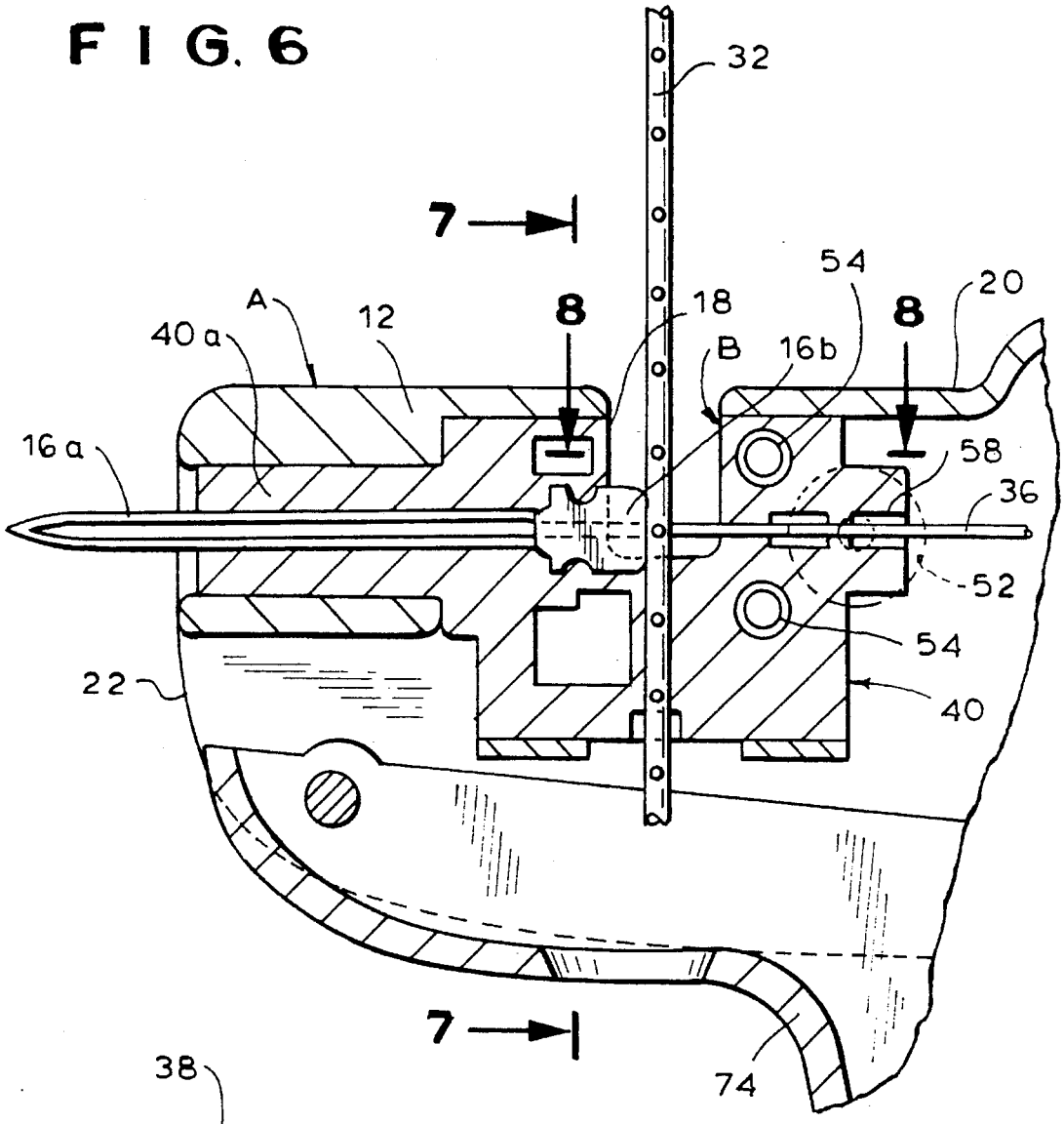
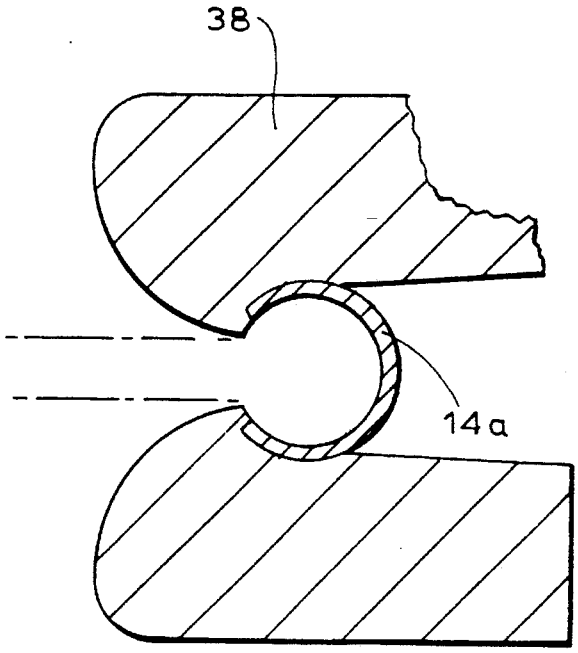
FIG. 11

FIG. 7
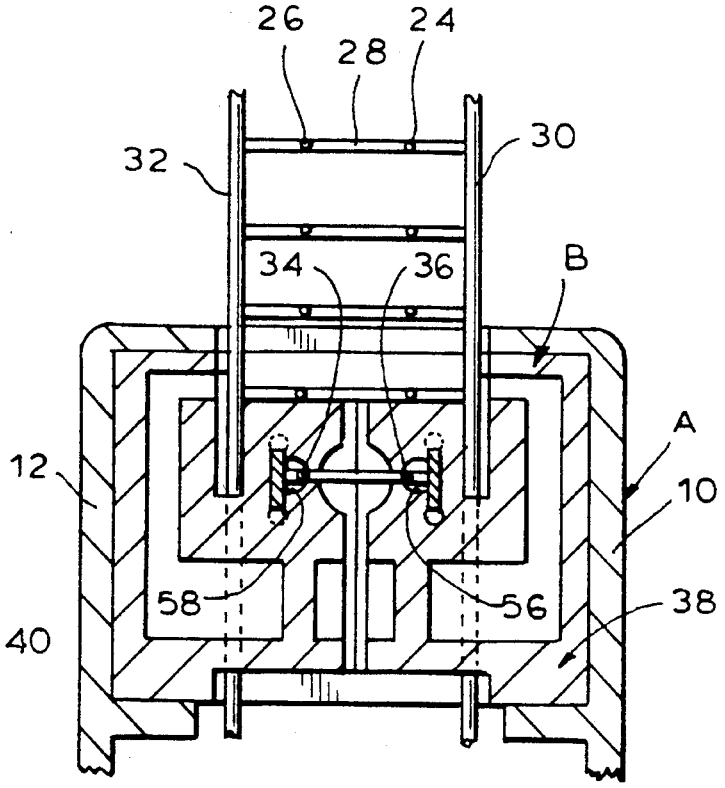
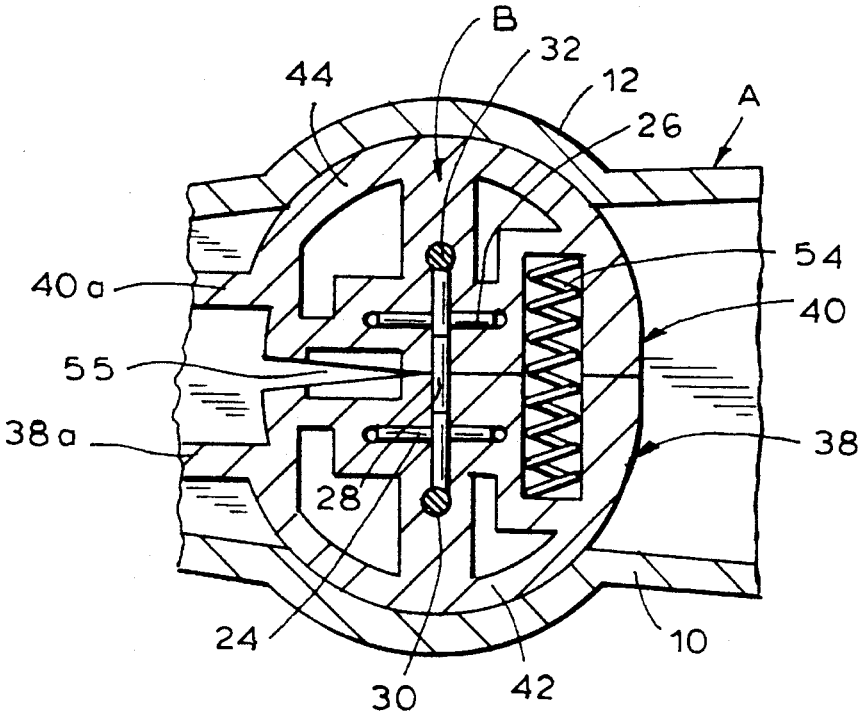
FIG. 8

FIG. 12
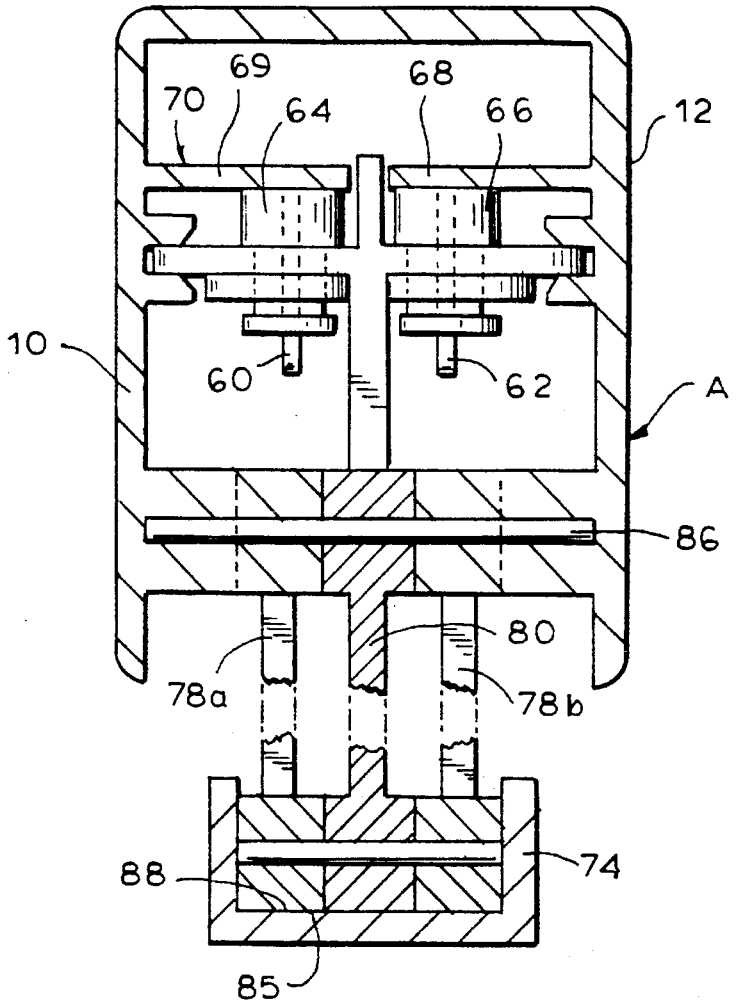
FIG. 9
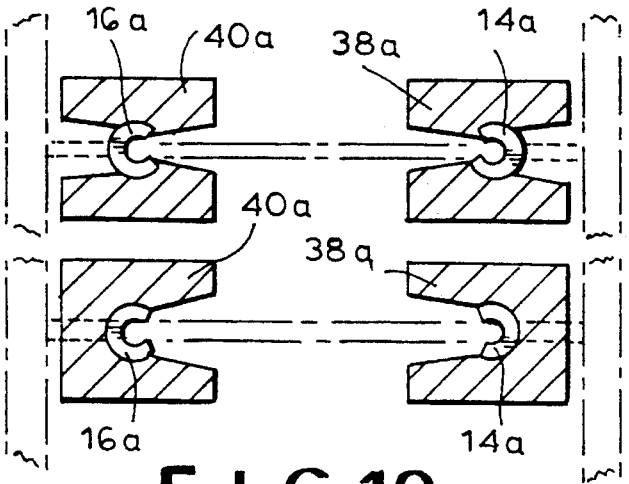
FIG. 10

DOUBLE NEEDLE BUTTON ATTACHER

The present invention relates to apparatus designed primarily for attaching buttons to garments or the like of the type which utilizes a pair of spaced hollow needles through which the "T" bar ends of plastic fasteners are dispensed and more particularly to a button attacher having a rigid housing enclosing needle support members which are moveable to vary the relative spacing between the needles to accommodate buttons with different thread hole spacing.

Attachers which dispense double "T" bar fasteners from clips with parallel connector bars, through fixed position parallel spaced hollow needles, are known. The attacher which is disclosed in my U.S. Pat. No. 5,020,713, issued Jun. 4, 1991 and entitled "Assembly of Attachments and Device for Attaching Same" is an example.

Such fixed position double needle attachers, although not specifically designed for attaching buttons, can be used for that purpose if the needle spacing is such that the needles can be received through the thread holes of the button. However, the fixed position nature of the needles presents a limitation on the usefulness of the attacher when it is used to attach buttons because, although the spacing between the thread holes of buttons of various sizes differs only to a relatively small extent, this difference is significant enough to prevent a fixed needle attacher from being used with many button sizes.

It is a general object of the present invention to provide an improved double needle attacher which includes a rigid housing defining a cavity into which freely moveable needle support members are received in a way which easily permits the attacher to accommodate buttons with thread holes having different spacing.

Double needle attachers with position adjustable needles are known in the art. For example, U.S. Pat. No. 4,361,101 entitled "Pocket Button Attaching Device" issued Nov. 30, 1982 to Walter H. W. Marsh et. al. teaches a device which consists of a single bifurcated needle support made of elastomeric material. The arms of the needle support can be squeezed together to move the needles. However, this device uses thread which must be tied to anchor the button. It is therefore not very easily or quick to use.

U.S. Pat. No. 4,533,076 entitled "Dispensing of Attachments" issued Aug. 6, 1985 to Donald L. Bourque teaches a double needle apparatus for dispensing plastic staples from a continuous roll of stock. The needle support members are pivotally mounted on a common shaft to make them position adjustable along an arcuate slot, to permit different size stock to be utilized. However, changing the position of the needles requires the loosing adjusting screws, moving the support members and retightening the screws. This requires a tool, such as a screw driver, to be used each time the position of the needle is altered.

Such a system may be adequate for an industrial attacher, where needle position changes are required only occasionally, such as when stock of a different size is used. However, it is highly inconvenient for the type of adjustments necessary in a consumer product to accomodate different buttons which must be quick and easy. Moreover, the Bourque attacher is designed to use roll stock of plastic staples for attaching tags. It cannot be used to dispense fasteners provided in clips which are more suitable for use in a consumer product.

A significant advance in the art of designing double needle attachers for consumer use in attaching buttons is represented by the attacher disclosed in U.S. Pat. No. 5,205,458 issued Apr. 27, 1993 entitled "Button Attacher With Variable Needle Spacing". In that attacher, the halves of the attacher housing, each of which carries one of the needles, are flexibly joined by a living hinge. Squeezing the halves brings the needles closer together so as to quickly and easily alter the needle spacing, as required by the button.

Although the attacher of U.S. Pat. No. 5,205,458 represented a significant step toward solving the problem of quickly and easily accomodating different size buttons, that design has proved difficult to implement in practice because of fabrication difficulties. In particular, using a single material which is molded into parts which are rigid in some areas and flexible in others proved difficult to achieve at a commercially acceptable price.

Another concern is the amount of force which must be applied by the user to the trigger in order to dispense the attachments. Repeated use of the attacher can lead to fatigue. It has been determined that most of the total force required during the attachment dispensing operation must be applied to the trigger at the beginning of the trigger stroke and near the end of the stroke. Thus, a significant advantage is achieved if the force at the beginning and near the end of the stroke can be reduced.

Even with conventional single connector bar attachments, at the beginning of the trigger stroke, a relatively large amount of force is required to sever the attachment from the connector bar which maintains the attachments in the clip. When double "T" bar end attachments with spaced parallel connector bars are involved, as here, the force requirement at the beginning of the stroke becomes even more significant because both connector bars would normally be severed from the attachments at the same time. This increases the peak force required at the beginning of the stroke dramatically.

Near the end of the stroke, a large amount of force is required to anchor the attachment because the filament is stretched somewhat, around the portion of the button between the thread holes, as the "T" bars are ejected from the needles and lodge on the opposite side of the fabric to secure the button. Thus, it is highly advantageous to make provision in a double needle button attacher for reducing the force applied to the trigger to complete attachment the operation.

In the present invention, the "T" bar ends of the fastener are severed from the connector bars at different times, reducing the peak force required at the beginning of the stroke. We have also greatly reduced the force near the end of the stroke by using a unique mechanical trigger linkage. The linkage has a mechanical advantage which increases at an increasing rate as the stroke progresses.

Ejector rod alignment is also an important concern. It is necessary to drive an ejector rod through the relatively long, small diameter channel in the needle to eject the "T" bar. If the ejector rod is not accurately aligned with the needle channel, binding may occur, resulting in jamming of the attacher and/or bending of the ejector rod. This alignment problem becomes particularly troublesome when a position adjustable needle is involved, and even more difficult to deal with when two position adjustable needles and two simultaneously driven ejector rods are employed.

The present invention overcomes the alignment problem by a unique method of mounting and guiding the ejector rods. The ejector rods are attached to the slide of the drive mechanism in a manner which permits the rods to change position relative to each other, and to the slide, as the needle support members move. Each ejector rod is positioned by a guide which is part of the support member of the associated needle and thus the rod always maintains suitable alignment with that needle, regardless of the relative positions of the needles.

It is therefore a prime object of the present invention to provide a double needle button attacher having a rigid housing defining a cavity into which needle support members are freely moveably received so to permit the relative position of the needles to be quickly and easily varied.

It is another object of the present invention to provide a double needle button attacher which employs a trigger linkage with a mechanical advantage which increases dramatically toward the end of the stroke of the trigger.

It is another object of the present invention to provide a double needle button attacher where each attachment is severed from the two connector bars at different times, reducing the peak amount of force necessary at the beginning of the trigger stroke.

It is still another object of the present invention to provide a double needle button attacher wherein the ejector rods are mounted to move with the associated needles to maintain alignment of the ejector rod therewith, as the relative positions of the needles change.

In accordance with one aspect of the present invention, apparatus is provided for dispensing attachments of the type having two "T" bar ends connected by a filament. The apparatus comprises a rigid hollow housing defining a cavity. First and second means for supporting first and second hollow needles respectively are freely moveably received within the housing cavity. First and second ejector rods are aligned with the first and second needles, respectively. Means are provided for driving the ejector rods so as to push the "T" bar ends of an attachment through with the needles. The needle support means are moveable within the housing cavity to permit movement of the needles relative to each other between a remote position and a proximate position. Means, accessible from the exterior of the housing, are provided for manipulating the needle support means to move the needles.

The housing defines a substantially cylindrical internal cavity with arcuate interior walls. The needle support means includes first and second oppositely oriented, independently moveable, arcuate bearing means situated within the cavity. The support means also comprises first and second needle mounting means. The needle mounting means are attached to and move with the first and second bearing means, respectively.

The biasing means may be provided acting on the needle support means. The biasing means urges the needle support means to move the needles towards the remote position.

Means are provided for moveably mounting each of the ejector rods to the ejector rod drive means. In this manner, each ejector rod can maintain alignment with the needle associated with it, regardless of the relative position of the needles.

The means for manipulating the needle support means preferrably comprises protrusion means extending through an opening in the housing. Preferably, the protrusion means comprises first and second sets of protrusions.

In accordance with another aspect of the present invention, apparatus is provided for dispensing attachments of the type having a "T" bar end. The apparatus comprises a housing having a hollow needle. An ejector rod is mounted within the housing. Means for driving the ejector rod are provided so as to push the "T" bar end of the attachment through the needle. Means are provided for actuating the ejector rod driving means. The actuating means includes trigger means pivotally mounted to the housing proximate one end thereof to permit the trigger means to move relative to the housing between first and second positions. Linkage means operably connect the trigger means with the ejector rod driving means. The trigger means and the linkage means cooperate to provide a mechanical advantage which increases at an increasing rate as the trigger means pivots relative to the housing, from the first toward the second position.

The linkage comprises first and second linkage arms each having first and second ends. The first end of the first arm is pivotally connected to the ejector rod driving means. The second end of the second arm is pivotally connected to the housing. The second end of the first arm is pivotally connected to the first end of the second arm to form a moveable joint.

The arms of the linkage form an angle at the joint. As the trigger pivots, the angle formed by the arms changes. The mechanical advantage of the linkage is dependent upon changes in the angle and increases dramatically as the angle approaches 180°, near the end of the stroke.

The ejector rod driving means includes a slide. Means are provided for guiding the slide for movement within the housing between eject and home positions, in a direction substantially parallel to the center line of the housing. Spring means are provided for urging the slide toward the home position.

The trigger means comprises a gripping surface. The gripping surface includes a protrusion.

The slide includes an extending portion to which the first arm of the linkage is pivotally connected. The first linkage arm is bifurcated and includes first and second spaced parts. The second ends of the parts of the first linkage arm are pivotally connected to the second linkage arm. The other end of the second linkage arm is pivotably connected to the housing.

In accordance with another aspect of the present invention, an apparatus is provided for dispensing attachments mounted in a clip between spaced connector bars. The attachments are of the type having first and second "T" bar ends connected by a filament. The apparatus includes a housing with first and second spaced hollow needles through which the "T" bar ends of successive attachments are dispensed. Means are provided for pushing the "T" bar ends of the attachments through the needles. Trigger means actuate the pushing means. Means are provided for severing the respective "T" bar ends of the attachments from their associated connector bars at different times during the actuation of the push means by said trigger means, to reduce the peak force necessary to sever the attachment from the connector bars.

In one preferred embodiment, one of the needles is offset with respect to the other, along a direction substantially parallel to the longitudinal axis of the housing, to accomplish the non-simultaneous severing operations. In particular, first and second means are provided for severing the "T" bar ends of the attachments from the associated connector bar. The severing means are associated with the first and second needles, respectively. Because the needles are longitudinally offset, the severing means associated with one of the needles severs the "T" bar end being dispensed through that needle from its connector bar before the severing means associated with the other needle severs the "T" bar end being dispensed through that needle from its connector bar.

In another preferred embodiment, the pushing means comprises a slide and first and second ejector rods. Means are provided for mounting the ejector rods to the slide at longitudinally offset locations.

In another preferred embodiment, one of the ejector rods is slightly longer than the other. This results in the severing operations taking place at slightly different times.

In accordance with another aspect of the invention, an apparatus is provided for dispensing attachments mounted in a clip between spaced connector bars. The attachments are of the type having first and second "T" bar ends connected by a filament. The apparatus includes a housing having a longitudinal axis. First and second spaced hollow needles are supported in the housing for relative movement. The "T" bar ends of successive attachments are dispensed through the needles. Means are provided for pushing the "T" bar ends of the attachments through the needles. Trigger means actuates the pushing means. The pushing means comprises a slide moveable within the housing in a direction substantially along the longitudinal axis of the housing. First and second ejector rods are associated with the first and second needles, respectively. Means are provided for individually moveably mounting the ejector rods on the slide, such that each ejector rod maintains alignment with the associated needle, regardless of the relative position of the needles.

The slide includes a laterally extending member. The ejector rod mounting means comprises first and second bearings independently mounted for movement along the laterally extending member.

The needle support means each include ejector rod guide means. The ejector rod guide means are attached to and move with the needle support means to maintain the ejector rods in alignment with the needles.

In accordance with the above and to such other objects which may hereinafter appear, the present invention relates to an improved double needle button attacher, as set forth in the following specification and recited in the annexed claims, taken together with the accompanying drawings, wherein like numerals refer to like parts, an in which:

FIG. 6 is an enlarged fragmentary side cross-sectional view of the front portion of a second preferred embodiment of the attacher;

FIG. 7 is a cross-sectional view of the front portion of the attacher, taken along line 7—7 of FIG. 6;

FIG. 8 is a top cross-section view of the front portion of the attacher, taken along line 8—8 of FIG. 6;

FIG. 9 is a front cross-sectional view of the needle holders, taken along line 9—9 of FIG. 4;

FIG. 10 is a front cross-sectional view of the needle holders, taken along line 10—10 of FIG. 4;

FIG. 11 is an enlarged fragmentary section of a needle mounting member; and

FIG. 12 is an enlarged fragmentary cross-sectional view, taken along line 12—12 of FIG. 4.

Figure 1:
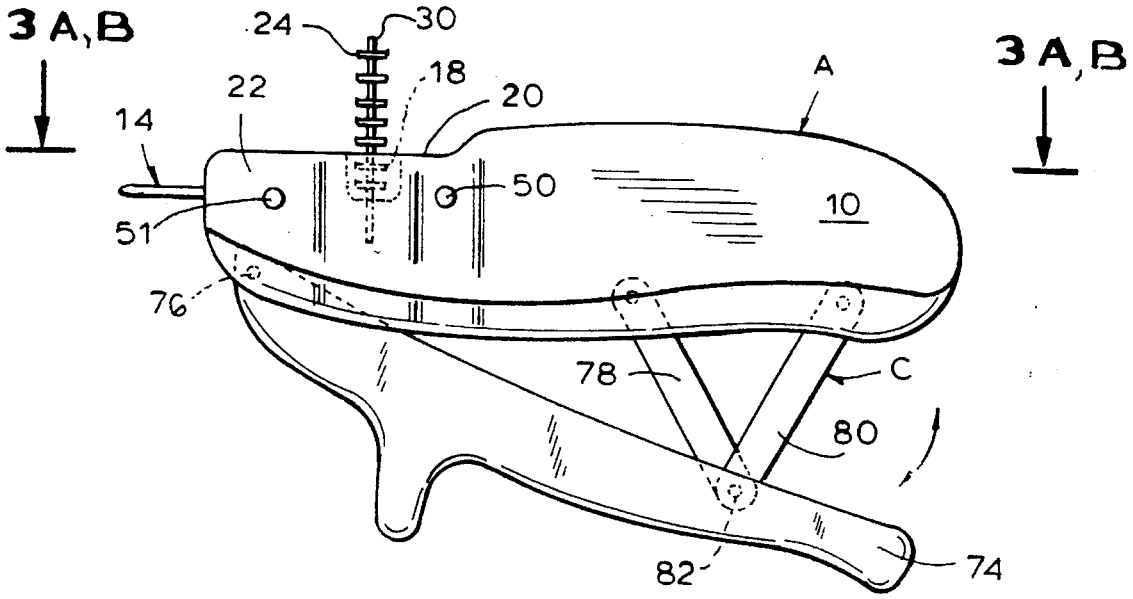
FIG. 1 is a side plan view of a first preferred embodiment the attacher of the present invention.

At best seen in FIG. 1, the attacher of the present invention consists of a housing, generally designated A, comprising two mirror image, injection molded, substantially rigid plastic housing halves 10, 12 joined together by conventional means, such as screws, to permit access to the interior for repair or by adhesive for a more permanent bond. Extending outwardly from the interior of the housing, through an opening in the front of the attacher, and beyond the front surface of the housing, are a pair of hollow steel needles, 14, 16, each of which is formed in tube-like fashion defining a channel with a slot.

Needles 14, 16 are carried on individual needle support members, collectively generally designated B, which are freely moveably received within a cavity formed inside the forward portion of the rigid housing. The needle support members B are moveable relative to each other to cause needles 14, 16 to change position and orientation relative to each other, to a limited extent (compare FIGS. 3A and 3B). In this manner, the attacher can be used with buttons of various sizes having different spacing between the thread holes.

The attacher is designed to receive a clip of attachments of the double "T" bar end type through an opening 18 in the top surface 20 of the forward portion 22 of housing A. Each clip consists of a plurality of substantially parallel attachments, each consisting of spaced "T" bar ends 24, 26 joined by a thin plastic filament 28. The clips are commonly injection molded with 25, 50 or 100 attachments each. The attachments are mounted at equally spaced intervals between connector (sometimes known as runner) bars 30, 32.

Support members B define an internal, substantially "H" shaped channel through which the clip of attachments may move vertically through the attacher. Many attachers include mechanisms for automatically advancing the clip along the channel. However, the illustrated embodiments are adapted for manual advancement of the clip through the attacher. The clip is advanced a distance equal to the spacing between attachments, to bring the next attachment into line with the plane of needles, each time the attacher is actuated.

After each attachment is moved into the plane of needles 14, 16, the attacher is actuated such that the "T" bar ends 24, 26 of the attachments are pushed through the needle channels and out of the needles. The needles have slots which face each other. The slots permit the filament 28 to move with the "T" bar ends, as the "T" bars travel down the needles.

The "T" bars are pushed through the needles by a pair of ejector rods 34, 36. Rods 34, 36 are moved by a linkage mechanism, generally designated C, which is driven by movement of a trigger. The trigger is pivotally mounted to the front of housing A so as to be moveable relative to housing A between an extended position (FIG. 1 and solid in FIG. 4) remote from housing A and a retracted position (phanton in FIG. 4) proximate housing A. The trigger is spring loaded toward the extended position. Squeezing the trigger toward the retracted position causes rods 34, 36 to move forward, engage the "T" bar ends of the aligned attachment and push the "T" bar ends through needles 14, 16. At the beginning of forward movement, the "T" bar ends are severed from their respective connector bars by knife blades 14*b*, 16*b*, which form the rear portions of the needles.

As the ejector rods approach the end of the forward motion, increased force is required. This is in part due to the fact that since buttons are made of relatively rigid plastic, in order to eject the "T" bars from the needle and properly situate them on the far side of the fabric from the button, filament 28 connecting the "T" bar ends 24, 28 must stretch to some extent. This stretching of the filament occurs near the end of the attaching operation, so that is where much of the force is required.

Certain improvements in the structure of the attacher compensate for the increased force requirements at the beginning and toward the end of the stroke. These include altering the effective length of the ejector rods such that the "T" bar ends of each attachment are severed from the respective connector bars at slightly different points during the stroke, instead of at the same point, such that the force required to sever the attachment is spread out and does not peak sharply at the beginning of the stroke. This can be achieved by using different length rods, offset mounting of the rods or offset mounting of the needles.

The increased force requirement during the final portion of the stroke is compensated for by the trigger linkage which has a mechanical advantage which increases at an increasing rate as the stroke progresses. Toward the end of the stroke, as the angle formed by the arms of the linkage approaches a straight angle, the mechanical advantage of the linkage is significantly enhanced.

Figure 5:
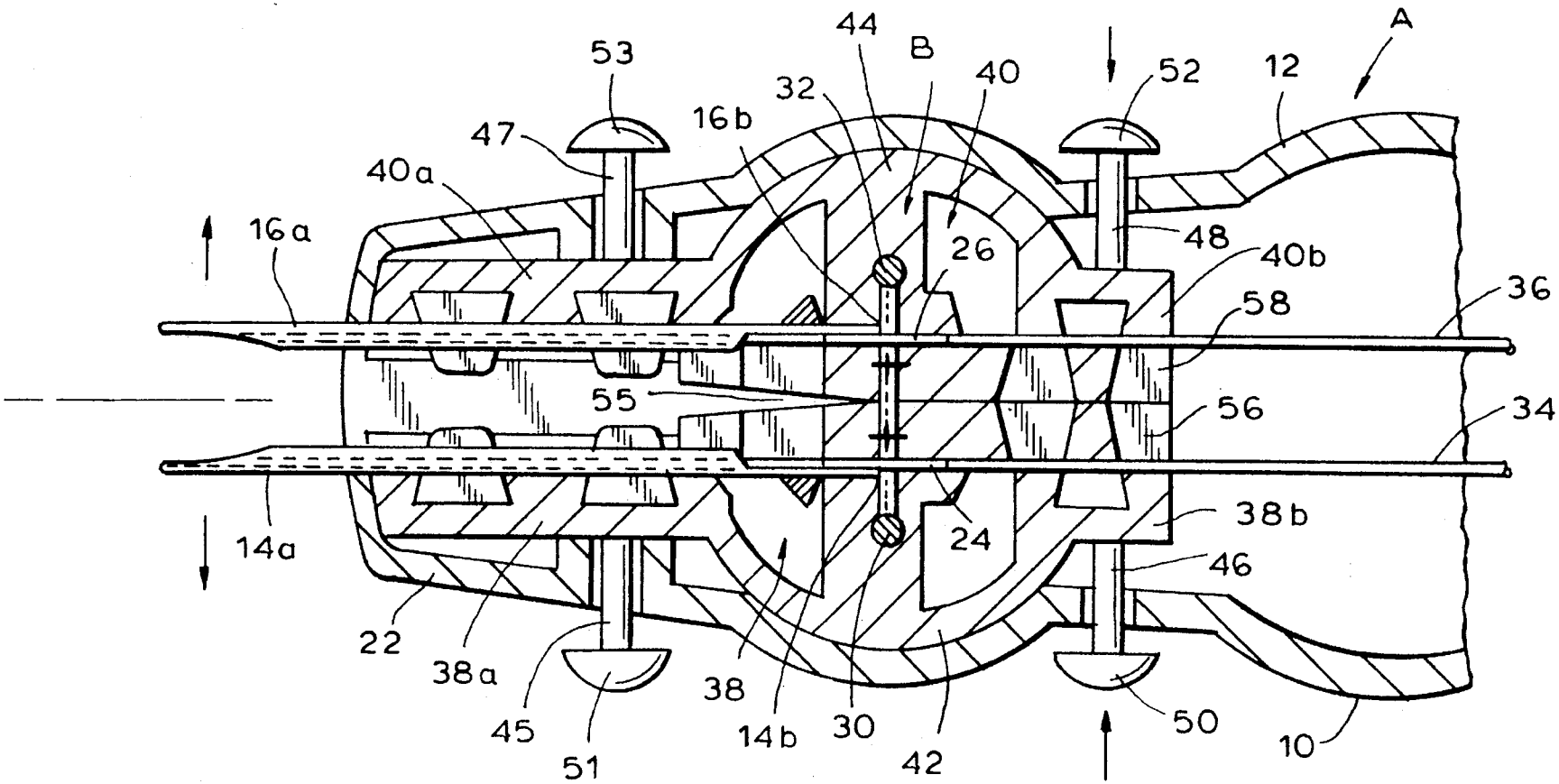
FIG. 5 is an enlarged fragmentary top cross-sectional view of the front portion of the attacher of FIG. 3A.

As best seen in FIGS. 5 and 6, each needle 14, 16 has a sharp tip at the end of a tubular body 14*a*, 16*a*, defining a channel with a slot. Each needle includes a rear portion which forms a flat blade 14*b*, 16*b* with a sharp edge. The edge of blade 14*b*, 16*b* forms the knife blade which acts to sever the "T" bar from the adjacent connector bar, as the attachments are dispensed.

The needles 14, 16 are mounted in an oppositely oriented position in a needle support B which is formed of two members, generally designated 38 and 40. In particular, as best seen in FIGS. 9, 10 and 11, each needle 14, 16, snap fits into the forward portion of the associated member 38, 40. Needle support members 38, 40 include first and second upstanding bearing walls 42, 44, respectively. The bearing walls 42, 44 have arcuate exterior surfaces which move along the arcuate walls of the interior of the housing cavity. Needle support members B are freely moveably received and independently moveable within a substantially oval housing cavity about axes defined by the centers of the cavity walls. Each needle support member 38, 40 has a forward extending portion 38*a*, 40*a* on which the body 14*a*, 16*a* of each needle is supported. By moving support members 38, 40 relative to each other, about vertical axes defined by the centers of the arcuate walls of the housing cavity, the spacing and orientation of the needles can be altered.

A seen in FIGS. 1–6, the forward portions 38*a*, 40*a* of the needle support members 38, 40 are each provided with an outwardly extending stem 45, 47 which extends through an opening in the housing. Enlarged heads 51, 53 are mounted on stems 47, 49 respectively. The needle support members 38, 40 each has a rearwardly extending portion 38*b*, 40*b* to which a stem 46, 48 is affixed. Stems 46, 48 protrude through openings in housing A and carry enlarged heads 50, 52 respectively.

Figure 3A:
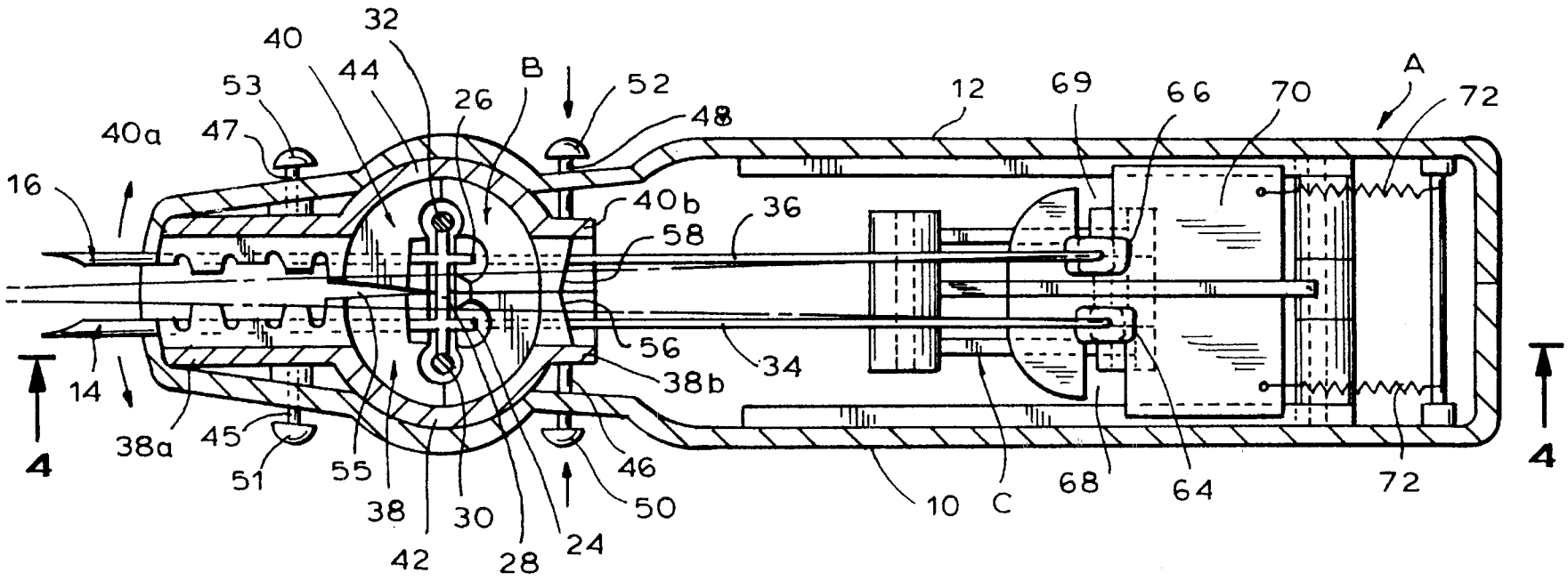
FIGS. 3A and 3B are top cross-sectional views of the attacher taken alone line 3—3 of FIG. 1, with the needles in the remote and in the proximate positions, respectively.
Figure 3B:
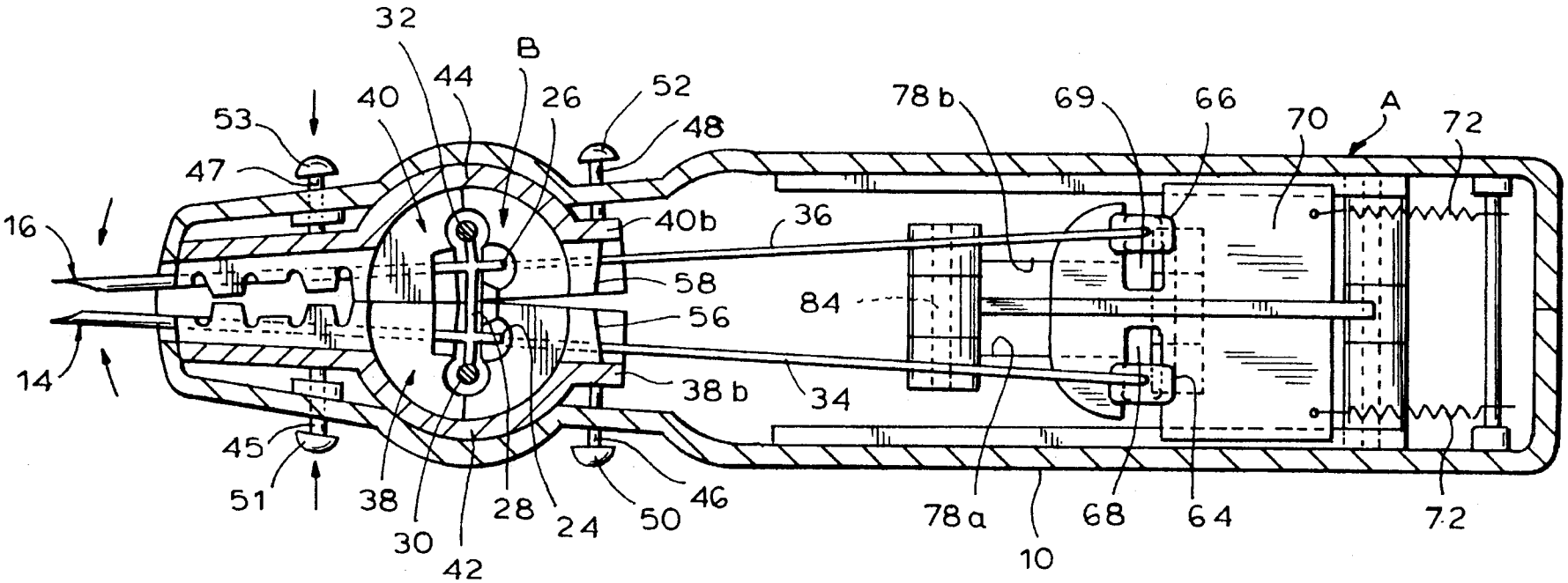

In this embodiment, two sets of stems are provided, a forward set 45, 47 and a rear set 46, 48. Pushing the rear set toward each other moves the needles apart (FIG. 3A). Pushing the forward set toward each other brings the needles toward each other (FIG. 3B).

As best seen in FIGS. 6 and 8, in the second preferred embodiment, the forward set of stems 45, 47 may be deleted and a pair of compression springs 54 situated in a cylindrical cavity formed in needle support members 42, 44. Springs 54 normally urge the rear portions of the members away from each other. The manual exertion of inwardly directed forces on heads 50, 52 will cause the rear portions of members 42, 44 to move toward each other, against the action of the springs 54, such that the tips of needles 14, 16 will move outwardly away from each other, from a proximate position in which the needles are relatively close to each other, toward a remote position to the degree required by the particular button being attached. In the extreme spread position, the needles are substantially parallel.

In both embodiments, needle support members 38, 40 are each provided with a slightly reduced forward surface so as to provide clearance at space 55 (FIG. 5). This permits limited rotation of the members relative to each other.

Figure 2A:
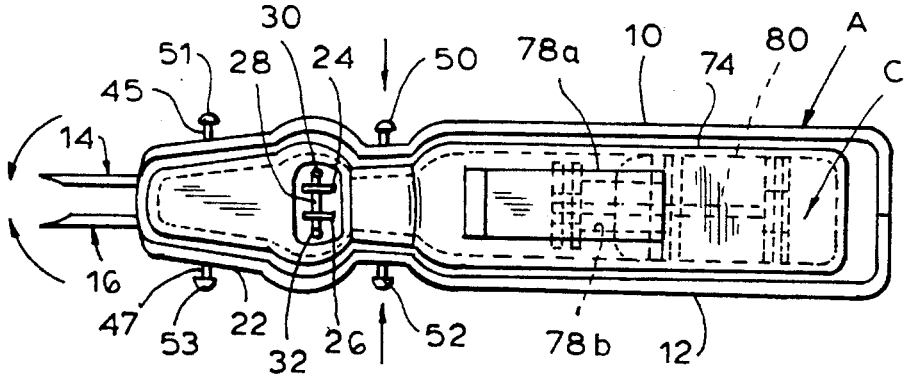
FIG. 2A is a bottom view of the attacher of FIG. 1, showing the trigger linkage.
Figure 2B:
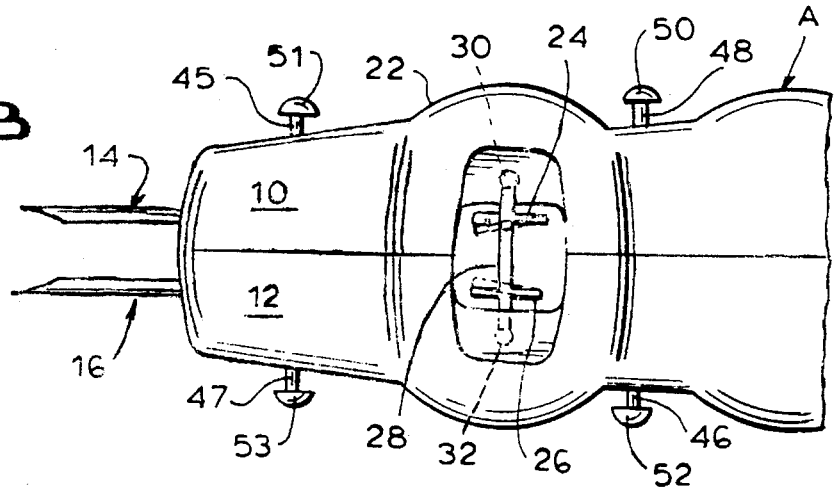
FIG. 2B is an enlarged fragmentary bottom view of the attacher of FIG. 1.

FIG. 2B illustrates the different positions of the T bar ends 24, 26 of an attachment as the needle support members 38, 40 change relative position. When the needles are substantially parallel, the T-bar ends are also substantially parallel, as shown in solid. When the needles are moved to a position proximate each other, the T-bar ends are slightly skewed with respect to each other, as shown in phantom in this figure.

The structure of both preferred embodiments also includes first and second ejector rod guides 56, 58 which are part of the rear portions 38*b*, 40*b* of members 38, 40, respectively, and serve to guide ejector rods 34, 36 to maintain alignment between the needles and the associated ejector rods, as the needle support members move. The rear ends of the ejector rods are mounted for lateral movement so as to accomodate this movement. In this way, the individual ejector rods move with the associated needles and are always colinear with the associated needle, regardless of the relative position of the needles.

Figure 4:
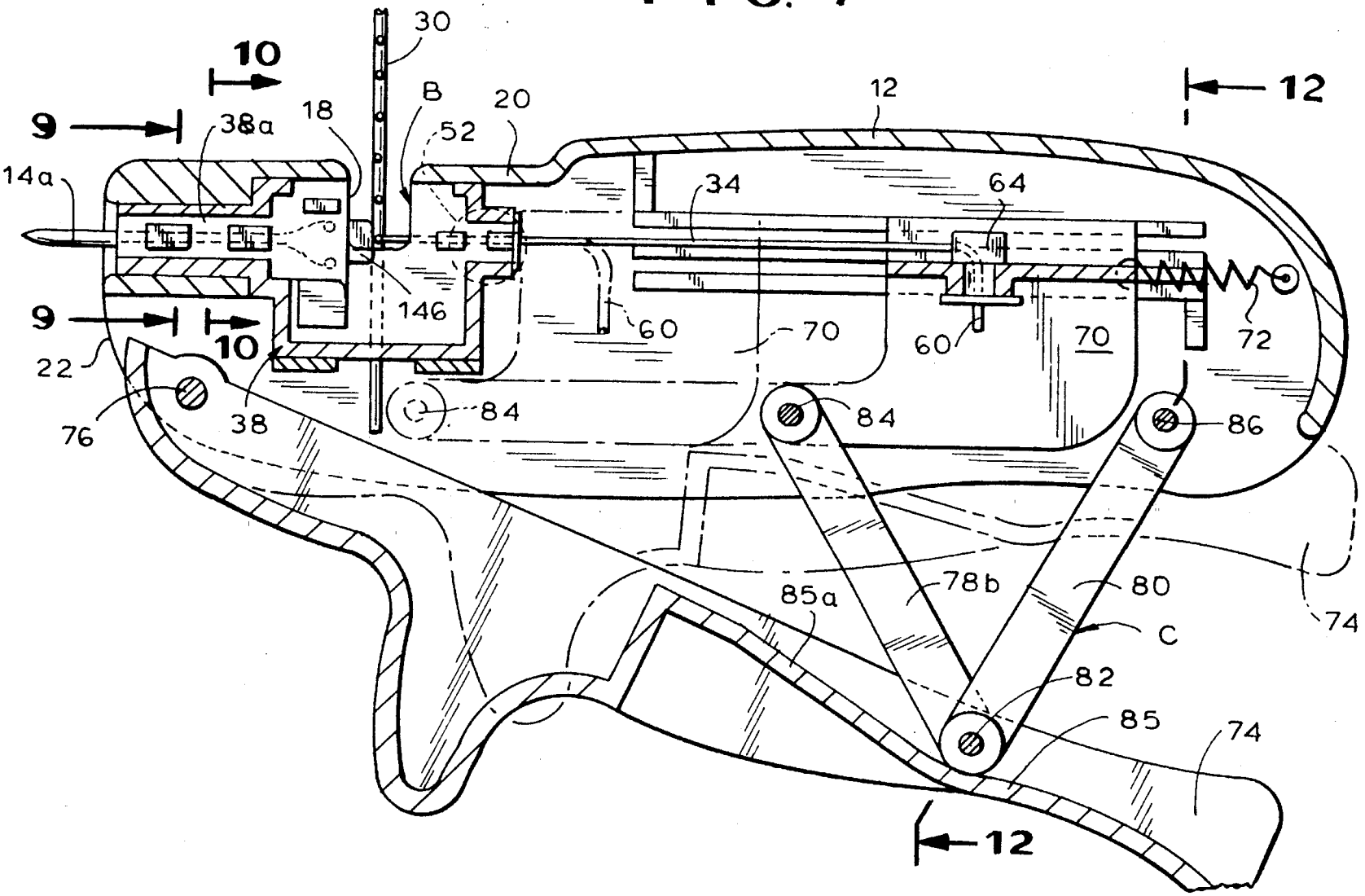
FIG. 4 is a side cross sectional view of the attacher showing the trigger and triangular linkage in the rest and eject positions.

The rear portions of the ejector rods 34, 36, as best seen in FIGS. 4 and 12, each have a downwardly bent portion 60, 62. Portions 60, 62 are received in bearings 64, 66 which are freely slideably received on separate halves of a laterally extending members 68, 69 which form a portion of slide 70. Slide 70 is connected to the trigger linkage C and moves from a home position (solid in FIG. 4) to an eject position (phanton in FIG. 4) to move ejection rods 34, 36. Slide 70 is spring loaded toward the rear of the housing by springs 72.

It will now be appreciated that bearings 64 and 66 and guides 56, 58, cooperate to maintain each ejector rod colinear with the aligned needle, throughout the stroke, regardless of the relative positions of the needles. This is essential to avoid bending of the rods and the maintenance of a smooth action.

As best seen in FIG. 3A, one of the bearings 66 may be mounted at a position forward of the other bearing 64 on slide 70. This may be achieved by having element 68 rearwardly offset as compared to element 69. This will cause the forward tip of ejector rod 36 to be positioned slightly ahead of the forward tip of ejector rod 34, as the ejector rods are simultaneously moved by slide 70. In this way, rod 36 pushes "T" bar end 26 aligned with it through needle 16 slightly ahead of the "T" bar end 28 which is pushed by rod 34. Thus, the "T" bar end 26 aligned with rod 36 will be severed by blade 16*b* from connector bar 32 slightly before the "T" bar end 26 aligned with rod 34 is severed by blade 14*b* from connector bar 30. The effect of severing the "T" bar ends at slightly different positions along the stroke is to spread out the force required at the beginning of the stroke and significantly reduce, actually cut in half, the peak force required to sever the attachment from the connector bars.

There are two other ways to achieve a similar result. One simple way is to make one ejector rod slightly shorter than the other. This is illustrated in FIG. 5, where rod 36 is shown to be slightly shorter than rod 34. The second way is to mount one needle slightly forward of the other needle. This is illustrated in FIG. 3B, where elements 68 and 69 of slide 70 are shown as colinear but needle 14 is mounted in member 38 slightly outwardly the point where needle 16 is mounted in member 40. Any of these options will result in the "T" bar ends being severed at slightly different positions along the stroke.

As best seen in FIGS. 4 and 12, a trigger 74 is pivotally mounted to housing A by internal shaft 76 such that the attacher has a scissor-like squeeze action. Trigger 74 is connected to slide 70 by a mechanical linkage which consists two linkage arms 78, 80 which are pivotally joined together at one end by a pin 82. The surface of the joint formed by linkage arms 78, 80 at pin 82 bears against a track 85 which is situated within trigger 74.

Linkage arm 78 is formed of two parts 78*a* and 78*b*. The forward ends of parts 78*a* and 78*b* are pivotally mounted to a pin 84 on slide 70. Linkage arm 80 consists of a single part which is pivotally connected to a pin 86 which is mounted in the rear of housing A between halves 10, 12 and behind the path of travel of slide 70.

Squeezing trigger 74 so as to move the trigger toward housing A causes the linkage arms to move from the position shown in solid in FIG. 4 to the position shown in phantom in that figure. As this occurs, the bottom surfaces 88 of the arm joint travel along inclined section 85*a* of track 85 and linkage arms 78, 80 spread apart such that slide 70 is moved forward against the action of springs 72. As the arms 78, 80 move apart, the angle formed between the arms (as seen from the side) changes from an acute angle to a straight angle. As this angle becomes larger, the mechanical advantage of the linkage changes trigonometrically, in accordance with a cotangent function, thereby increasing the force transmitted from the trigger to the slide, as the stroke progresses. Specifically, the mechanical advantage of the linkage increases at an increasing rate throughout the stroke. In this way, a greater portion of the force is transmitted near the end of the stroke, during the time when the filament is being stretched.

It will now be appreciated that the present invention is an attacher with a rigid housing forming a cavity into which needle support members are freely moveably received to permit easy and quick adjustment of needle spacing and orientation to accomodate different size buttons. The force normally required to be applied on the trigger at the beginning of the stroke to sever both "T" bar ends is reduced by having the respective severing operations occur at different times, either by mounting one needle or one ejector rod forward of the other or by altering the length of one of the ejector rods. The force normally required to be applied to the trigger toward the end of the stroke is reduced by providing a linkage associated with the trigger which has a mechanical advantage which increases dramatically near the end of the stroke. Ejector rod alignment is maintained by a floating ejector rod mounting structure.

While only a limited number of preferred embodiments have been disclosed for purposes of illustration, it should be apparent that many variations and modifications could be made thereto. It is intend to cover all of these variations and modifications which fall within the scope of the present invention, as defined by the following claims:

We claim:

1. Apparatus for dispensing attachments of the type having two "T" bar ends connected by a filament, the apparatus comprising a rigid hollow housing defining a cavity, means freely moveably received within said cavity for supporting first and second hollow needles, first and second ejector rods aligned with said first and second needles, respectively, means for driving said ejector rods to push the "T" bar ends of an attachment through said needles, said needle support means being moveable within said housing cavity to permit movement of said needles relative to each other between proximate and remote positions, and means, accessible from the exterior of said housing, for moving said needle support means.

2. The apparatus of claim 1 where said housing cavity comprises interior walls and where said needle support means comprises first and second needle support members situated and independently moveable within said housing cavity along a path defined by said interior cavity walls.

3. The apparatus of claim 2 wherein said interior cavity walls are arcuate.

4. The apparatus of claim 2 wherein each of said members comprises a bearing member with an arcuate wall.

5. The apparatus of claim 1 further comprising means for biasing said needle support means to move said needles toward said proximate position.

6. The apparatus of claim 1 wherein said means for moving said needle support means comprises protrusion means accessible from the exterior of said housing.

7. The apparatus of claim 6 wherein said protrusion means comprises a first set of protrusions each located on a different side of said housing.

8. The apparatus of claim 6 wherein said protrusion means comprises first and second sets of protrusions, one protrusion in each of said sets being located on a different side of said housing.

9. The apparatus of claim 1 further comprising means for individually moveably mounting said ejector rods to said ejector rod drive means.

10. The apparatus of claim 1 comprising means for snap fiting said needles into said needle mounting means.

* * * * *